US010221474B2

(12) United States Patent
Kobayashi et al.

(10) Patent No.: US 10,221,474 B2
(45) Date of Patent: Mar. 5, 2019

(54) METHOD OF PRODUCING NI-BASED SUPERALLOY

(71) Applicant: HITACHI METALS, LTD., Tokyo (JP)

(72) Inventors: Shinichi Kobayashi, Yasugi (JP); Tomonori Ueno, Yasugi (JP); Takehiro Ohno, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/557,285

(22) PCT Filed: Mar. 24, 2016

(86) PCT No.: PCT/JP2016/059414
§ 371 (c)(1),
(2) Date: Sep. 11, 2017

(87) PCT Pub. No.: WO2016/152982
PCT Pub. Date: Sep. 29, 2016

(65) Prior Publication Data

US 2018/0057921 A1 Mar. 1, 2018

(30) Foreign Application Priority Data

Mar. 25, 2015 (JP) ..... 2015-062842

(51) Int. Cl.
*C22F 1/10* (2006.01)
*B21J 1/06* (2006.01)
(Continued)

(52) U.S. Cl.
CPC *C22F 1/10* (2013.01); *B21J 1/06* (2013.01); *B21J 5/00* (2013.01); *B21J 13/02* (2013.01);
(Continued)

(58) Field of Classification Search
CPC ..... C22C 19/056; C22F 1/10
See application file for complete search history.

(56) References Cited

U.S. PATENT DOCUMENTS 5,413,752 A 5/1995 Kissinger et al.
5,759,305 A 6/1998 Benz et al.
(Continued)

FOREIGN PATENT DOCUMENTS

CN 101072887 11/2007
CN 102392147 3/2012
(Continued)

OTHER PUBLICATIONS

Fahrmarin et al., "Effect of Cooling Rate on Gleeble Hot Ductility of UDIMET Alloy 720 Billet", Superalloys: 311-316 (2008).
(Continued)

*Primary Examiner* — Jessee R Roe
(74) *Attorney, Agent, or Firm* — Wenderoth, Lind & Ponack, L.L.P.

(57) ABSTRACT

A method of producing a Ni-based super heat-resistant alloy in which a hot working material is subjected to hot working with a mold is provided. The hot working material consists of, in mass%, 0.001 to 0.050% of C, 1.0% to 4.0% of Al, 3.0% to 7.0% of Ti, 12% to 18% of Cr, 12% to 30% of Co, 1.5% to 5.5% of Mo, 0.5% to 2.5% of W, 0.001% to 0.050% of B, 0.001% to 0.100% of Zr, 0% to 0.01% of Mg, 0% to 5% of Fe, 0% to 3% of Ta, 0% to 3% of Nb, and the remainder of Ni and impurities. The method includes: heating and holding the hot working material in a temperature range of 950° C. to 1150° C. for 1 hour or longer; and performing hot working on the material with the mold that is heated to a temperature range of 800° C. to 1150° C.

7 Claims, 3 Drawing Sheets

RELATIONSHIP BETWEEN TEMPERATURE DECREASE OF HOT WORKING MATERIAL AND REDUCTION IN AREA

: HOT WORKING MATERIAL A
: HOT WORKING MATERIAL B

(51) Int. Cl.

| | |
|---|---|
| ***B21J 5/00*** | (2006.01) |
| ***B21J 13/02*** | (2006.01) |
| ***C22C 19/05*** | (2006.01) |
| *C22F 1/00* | (2006.01) |

(52) U.S. Cl.

CPC ..... *C22C 19/05* (2013.01); *C22C 19/051* (2013.01); *C22C 19/056* (2013.01); *C22F 1/00* (2013.01)

(56) References Cited

U.S. PATENT DOCUMENTS

| | | | |
|---|---|---|---|
| 6,059,904 | A | 5/2000 | Benz et al. |
| 2008/0260570 | A1 | 10/2008 | Harada et al. |
| 2011/0194971 | A1 | 8/2011 | Harada et al. |
| 2016/0108506 | A1 | 4/2016 | Sato et al. |

FOREIGN PATENT DOCUMENTS

| | | |
|---|---|---|
| CN | 103934397 | 7/2014 |
| EP | 2 312 000 | 4/2011 |
| JP | 3-174938 | 7/1991 |
| JP | 9-302450 | 11/1997 |
| WO | 2006/059805 | 6/2006 |
| WO | 2014/157144 | 10/2014 |

OTHER PUBLICATIONS

International Search Report and Written Opinion of the International Search Authority, dated Jun. 14, 2016 in corresponding International Application No. PCT/JP2016/059414, with English language translation.

Japanese Office Action, dated Aug. 15, 2017 in corresponding Japanese Patent Application No. JP 2017-508429, with English language translation.

Office Action dated Jul. 27, 2018 in Chinese Application No. 201680015315.0.

Extended European Search Report issued Nov. 6, 2018 in European Application No. 16768885.2.

RELATIONSHIP BETWEEN TEMPERATURE DECREASE OF HOT WORKING MATERIAL AND REDUCTION IN AREA

: HOT WORKING MATERIAL A
: HOT WORKING MATERIAL B

HOT WORKING MATERIAL A

HOT WORKING MATERIAL B

HOT WORKING MATERIAL A
(MATERIAL BEFORE FORMING)

HOT WORKED MATERIAL A
(DISK AFTER FORMING)

HOT WORKING MATERIAL B
(MATERIAL BEFORE FORMING)

HOT WORKED MATERIAL B
(DISK AFTER FORMING)

MACROSTRUCTURE FIGURE
OF HOT WORKING MATERIAL C

HOT WORKING MATERIAL C

METHOD OF PRODUCING NI-BASED SUPERALLOY

TECHNICAL FIELD

The present invention relates to a method of producing a Ni-based superalloy.

BACKGROUND ART

A Ni-based superalloy which includes many alloy elements such as Al and Ti and is a γ' (gamma prime) phase-precipitation strengthened type is used as a heat resistant member for aircraft engines and gas turbines for power generation.

A Ni-based forged alloy has been used as a turbine disk which requires high strength and reliability among components of a turbine. Here, the forged alloy is a term used in contrast to a cast alloy having a cast solidification structure which is used itself. The forged alloy is a material produced through a process in which an ingot obtained by melting and solidification is subjected to hot working and thereby a predetermined component shaped is made. Since hot working causes a cast solidification structure which is coarse and heterogeneous to be changed to a forged structure which is fine and homogeneous, mechanical characteristics such as tensile characteristics or fatigue characteristics are improved. For engine members for an aircraft and a gas turbine member for power generation, the temperature exposed and the degree of stress loaded during an operation of a turbine is deferent among the members. Thus, it is necessary that the balance between yield strength, fatigue strength, and creep strength of a material is optimized in accordance with a load status of each of the members. Generally, when the balance is optimized, it is important to allow a control of a grain size of a γ (gamma) phase forming a matrix in a Ni-based superalloy, in accordance with the purpose of a use. In order to improve yield strength or fatigue strength, it is important to reduce the grain size of grains in the matrix. However, as the size of materials of a product is increased, it becomes much more difficult to strictly control the grain size.

In order to improve engine efficiency, it is effective that a turbine is operated at an extremely high temperature. For this, it is necessary that a durable temperature of each turbine member is set to be high. In order to increase the durable temperature of a Ni-based superalloy, it is effective that the amount of the γ' phase is increased. Thus, an alloy having a large amount of the precipitated γ' phase is used in a member requiring high strength, among forged alloys. The γ' phase corresponds to an intermetallic compound including $Ni_3Al$. The material strength is increased more by dissolving elements which are represented by Ti, Nb, and Ta, in the γ' phase. However, if the amount of Al, Ti, Nb, or Ta which is a constituent element of such a γ' phase is increased, the amount of the γ' phase which is a strengthening phase becomes excessive, and thus, it is difficult to perform hot working represented by press forging and the excessive amount of the γ' phase causes a crack to occur in a hot working material in production. Thus, a component such as Al or Ti, which contributes to strengthening is generally limited in comparison to a cast alloy which is obtained without hot working. As a turbine disk material having strongest a strength currently, Udimet720Li (Udimet® is a registered trademark of Special Metals Co., Ltd.) is exemplified. In mass %, the amount of Al is 2.5% and the amount of Ti is 5.0%. The amount of the γ' phase is about 45% at 760° C. Since Udimet720Li has a high strength and has a large amount of the γ' phase, Udimet720Li is one of Ni-based superalloys on which performing hot working is most difficult.

As described above, regarding the forged alloy used in a turbine disk, a big challenge for a material is to achieve both strength and hot workability, and an alloy component for solving this challenge and a producing method thereof are researched.

For example, Patent Document 1 discloses the invention of a high-strength alloy which can be produced by a melting and forging process in the related art. In comparison to Udimet720Li, the alloy includes a lot of Ti and has a high structural stability by adding a lot of Co, and hot working is also possible. However, this alloy also has the amount of the γ' phase which is 45% to 50%, that is, large similarly to that in Udimet720Li. Thus, hot working is very difficult.

There is an attempt to improve hot workability by a production process. In Patent Document 1, regarding a forged article of Udimet720Li, an experiment result in that hot workability is improved as a cooling rate after the temperature is increased to 1110° C. becomes slower is disclosed. Although improvement of hot workability by a heat treatment is an important knowledge, in a practical hot-working process, after a hot working material is drawn out from a heating furnace, a surface temperature of the hot working material is significantly decreased by a contact with an outside air or a die of a hot working device. At this time, a problem remains in that the γ' phase is precipitated in the process of cooling the surface of the material, and the precipitated γ' phase causes deformation resistance to be increased and causes a hot working crack in the surface.

In a case where a Ni-based superalloy which has a large amount of the γ' phase constituent element such as Al and Ti is subjected to hot working, the followings are known. The γ' phase is precipitated by decreasing the temperature of the material during the hot working. Thus, hot workability of the hot working material is significantly degraded and a crack often occurs in the hot working material by the working. Therefore, in a case where it is assumed that such a Ni-based superalloy is subjected to hot working, various attempts for suppressing the decrease of the temperature of the material during the hot working are made.

For example, a method in which working is ended before the temperature of the material is decreased, by increasing a working speed, or a method in which the working amount for one time is reduced and hot working is performed by performing reheating plural number of times is considered. If the working speed is increased as in the former case, modification of a microstructure by working heat generation, that is, coarsening of crystal grains of a γ matrix phase or incipient melting at a grain boundary of the matrix easily occurs. In the latter case, there are problems in that the amount of hot working for one time is necessarily small and energy required for production is increased, and that, since non-uniform deformation by hot working plural number of times easily occurs, it is difficult to obtain a desired product shape, and that homogeneity of the microstructure is easily lost.

CITATION LIST

Patent Document

Patent Document 1: Pamphlet of International Publication No. WO2006/059805

Non Patent Document

Non Patent Document 1: Proceedings of the Eleventh International Symposium on Super Alloys (TMS, 2008) 311-316 pages

SUMMARY OF INVENTION

Problems to be Solved by the Invention

The above-described Udimet720Li or the alloy disclosed in Patent Document 1 has very excellent characteristics as a forged alloy. However, since a lot of the γ' phase is included, a temperature range which allows working is narrow and the working amount for one time is necessarily small. Thus, it is estimated that a production process of repeating working and reheating many times is required. Since a lot of the γ' phase is included, the deformation resistance is high. Also, an incipient melting temperature at a grain boundary is low. Thus, in a case where a working speed is high, load on a hot working device may be large. In addition, the grain boundary of an alloy may be partially melted and thus a crack may occur in the material.

If hot working of such an alloy can be stably performed, it is possible to reduce a time or energy required for production and yield of the material is also improved. As a result, it is possible to stably obtain a Ni-based superalloy which has good quality and high strength, and to stably supply a product for an aircraft engine or a gas turbine for power generation.

An object of the present invention is to provide a method of producing a Ni-based superalloy which is used in an aircraft engine or a gas turbine for power generation and has a high strength, and in which good hot workability is maintained even if the Ni-based superalloy which would have poor hot workability is subjected to hot working.

Means for Solving the Problems

The inventors have examined a producing method for an alloy having various components which have a composition causing a large amount of the γ' phase to be precipitated, and found the followings. Any of a heating process suitable for a hot working material, a die surface temperature of a die used in a hot working device, and a strain rate in hot working is selected so as to obtain good balance, and thus a change of a temperature during hot working of the hot working material is small, precipitation of the γ' phase is suppressed, and an adequate working speed is maintained. Therefore, it is possible to suppress coarsening or incipient melting of crystal grains in a microstructure, which occurs in the hot working material by working heat generation during hot working. As a result, the inventors have found that a hot working material to be produced can be obtained which has good quality such that a surface crack by the decrease of a temperature or coarsening and incipient melting of crystal grains by working heat generation does not occur, and have achieved the present invention.

That is, according to the present invention, there is provided a method of producing a Ni-based superalloy with a die heated to a predetermined temperature. The hot working material has a composition consisting of, in mass %, 0.001% to 0.050% of C, 1.0% to 4.0% of Al, 3.0% to 7.0% of Ti, 12% to 18% of Cr, 12% to 30% of Co, 1.5% to 5.5% of Mo, 0.5% to 2.5% of W, 0.001% to 0.050% of B, 0.001% to 0.100% of Zr, 0% to 0.01% of Mg, 0% to 5% of Fe, 0% to 3% of Ta, 0% to 3% of Nb, and the remainder of contains Ni and impurities. The method includes a hot working material heating process of heating and holding the hot working material in a temperature range of 950° C. to 1150° C. for 1 hour or longer, and a hot working process of performing hot working on the hot working material with the die that is heated to the temperature in a range of 800° C. to 1150° C.

Preferably, in the method of producing a Ni-based superalloy, in the hot working process, working is performed at a strain rate of 0.1/second or smaller and a surface temperature of the hot working material when hot working is ended is set to be in a range of 0° C. to −200° C. with respect to a heating temperature of the hot working material.

Further preferably, in the method of producing a Ni-based superalloy, the strain rate of the hot working process is set to be equal to or smaller than 0.05/second, and the surface temperature of the hot working material when hot working is ended is set to be in a range of 0° C. to −100° C. with respect to the heating temperature of the hot working material.

More preferably, in the method of producing a Ni-based superalloy, in the hot working process, an atmosphere is in an air and a Ni-based superalloy of a solid-solution strengthened type is provided on at least a work surface of the die.

Advantageous Effects of Invention

According to the present invention, in a Ni-based superalloy which is used in an aircraft engine, a gas turbine for power generation, or the like and has high strength, since crack in the surface of the produced hot working material by the decrease of the temperature does not occur, yield of the material is improved in comparison to that in a producing method of the related art. In addition, it is possible to obtain a hot working material having a homogeneous microstructure in which coarsening or incipient melting of crystal grains by working heat generation does not occur. Since strength is higher than that of an alloy used in the related art, an operation temperature can be increased and contribution to high efficiency is expected by using the material in the above-described heat engine.

EMBODIMENTS FOR CARRYING OUT THE INVENTION

Figure 1:
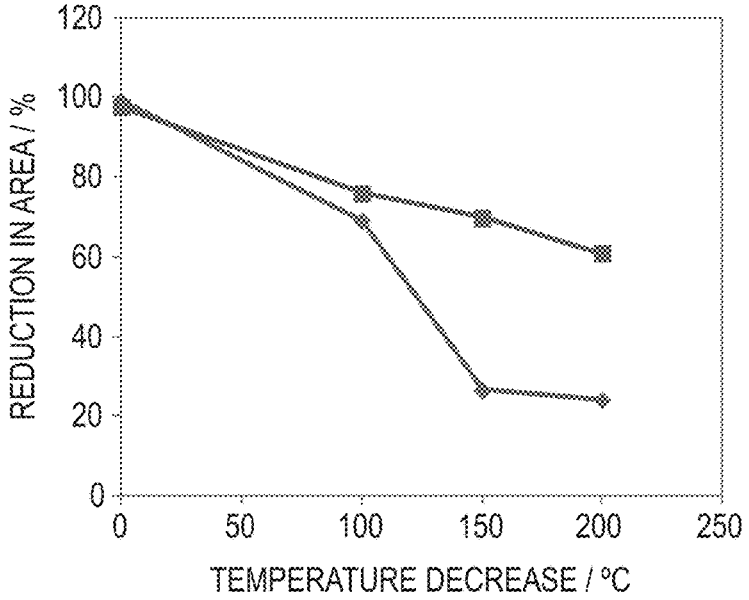
FIG. 1 is a diagram illustrating a relationship between a decrease of a temperature and reduction in area of a hot working material.

Features of the present invention are as follows. Regarding a Ni-based superalloy in which hot working is difficult by using a method in the related art, or a long period or large energy is required for hot working, any of a heating process suitable for a hot working material, a die surface temperature of a die used in a hot working device, and a strain rate in hot working is appropriately managed, and thus a good hot working material in which cracks in the surface of the produced hot working material by the decrease of the temperature do not occur or coarsening and incipient melting of crystal grains by working heat generation do not occur. Hereinafter, a configuration requirement of the present invention will be described.

Firstly, a reason of limiting an alloy component range defined in the present invention will be described. The following component value is indicated by mass %.

C: 0.001% to 0.050%

C has an effect of increasing strength of a grain boundary. This effect is exhibited when the amount of C is equal to or greater than 0.001%. In a case where C is excessively contained, a coarse carbide is formed and thus, strength and hot workability are decreased. Thus, 0.050% is set to be an upper limit. A preferable range for more reliably obtaining the effect of C is 0.005% to 0.040%, a further preferable range is 0.01 to 0.040%, and a more preferable range is 0.01 to 0.030%.

Cr: 12% to 18%

Cr is an element that improves oxidation resistance and corrosion resistance. 12% or more of Cr are required for obtaining the effect. If Cr is excessively contained, a brittle phase such as a σ (sigma) phase is formed, and thus strength and hot workability are decreased. Thus, an upper limit is set to 18%. A preferable range for more reliably obtaining the effect of Cr is 13% to 17%, and a more preferable range is 13% to 16%.

Co: 12% to 30%

Co can improve stability of a structure and maintain hot workability even if a lot of Ti which is a strengthening element is contained. 12% or more of Co are required for obtaining the effect. As Co is contained more, hot workability is improved. However, if Co is excessive, a harmful phase such as a σ phase or a η (eta) phase is formed, and thus strength and hot workability are decreased. Thus, an upper limit is set to 30%. In both aspects of strength and hot workability, 13% to 28% is a preferable range and 14% to 26% is more preferable range.

Al: 1.0% to 4.0%

Al is an essential element that forms a γ' ($Ni_3Al$) phase which is a strengthening phase and improve high-temperature strength. In order to obtain the effect, 1.0% of Al in minimum is required. However, excessive addition causes hot workability to be decreased and causes material defects such as a crack in working to occur. Thus, the amount of Al is limited to a range of 1.0% to 4.0%. A preferable range for more reliably obtaining the effect of Al is 1.5% to 3.0%, a further preferable range is 1.8% to 2.7%, and a more preferable range is 1.9% to 2.6%.

Ti: 3.0% to 7.0%

Ti is an essential element that causes the γ' phase to be subjected to solid-solution strengthening and increases high-temperature strength by being substituted at an Al site of the γ' phase. In order to obtain the effect, 3.0% of Al in minimum is required. However, excessive addition causes the γ' phase to become unstable at a high temperature and causes coarsening. In addition, the harmful η phase is formed and hot workability is impaired. Thus, an upper limit of Ti is set to 7.0%. A preferable range for more reliably obtaining the effect of Ti is 3.5% to 6.7%, a further preferable range is 4.0% to 6.5%, and a more preferable range is 4.5% to 6.5%.

Mo: 1.5% to 5.5%

Mo has an effect of contributing to solid-solution strengthening of a matrix and improving high-temperature strength. In order to obtain the effect, 1.5% or more of Mo is required. However, if Mo is excessively contained, the brittle phase such as the σ phase is formed, and thus high-temperature strength is impaired. Thus, an upper limit is set to 5.5%. A preferable range for more reliably obtaining the effect of Mo is 2.0% to 3.5%, a further preferable range is 2.0% to 3.2%, and a more preferable range is 2.5% to 3.0%.

W: 0.5% to 2.5%

Similar to Mo, W is an element that contributes to solid-solution strengthening of the matrix and, in the present invention, 0.5% or more of W is required. If W is excessively contained, a harmful intermetallic compound phase is formed and high-temperature strength is impaired. Thus, an upper limit of W is set to 2.5%. A preferable range for more reliably obtaining the effect of W is 0.7% to 2.2% and a further preferable range is 1.0% to 2.0%.

B: 0.001% to 0.050%

B is an element that improves grain boundary strength and improves creep strength and ductility. 0.001% of B in minimum is required for obtaining the effect. B has a large effect of decreasing a melting point and workability is hindered if a coarse boride is formed. Thus, a control so as not to exceed 0.05% is needed. A preferable range for more reliably obtaining the effect of B is 0.005% to 0.04% , a further preferable range is 0.005% to 0.03%, and a more preferable range is 0.005% to 0.02%.

Zr: 0.001% to 0.100%

Zr has an effect of improving grain boundary strength similar to B. 0.001% of Zr in minimum are required for obtaining the effect. If Zr is excessively contained, the decrease of the melting point is caused and high-temperature strength and hot workability are hindered. Thus, an upper limit is set to 0.1%. A preferable range for more reliably obtaining the effect of Zr is 0.005% to 0.06% and a further preferable range is 0.010% to 0.05%.

Mg: 0% to 0.01%

Mg has an effect of improving hot ductility by fixing S, which is inevitable impurity that is segregated at a grain boundary and hinders hot ductility, as a sulfide. Thus, if necessary, Mg may be added. However, if the large amount of Mg is added, surplus Mg functions as a factor of hindering hot ductility. Thus, an upper limit is set to 0.01%.

Fe: 0% to 5%

Fe is a cheap element. If containing Fe is allowed, it is possible to reduce raw material cost of a hot working material. Thus, if necessary, Fe may be added. However, if Fe is excessively added, Fe causes easy precipitation of the σ phase and deterioration of mechanical properties. Thus, an upper limit is set to 5%.

Ta: 0% to 3%

Similar to Ti, Ta is an element that causes the γ' phase to be subjected to solid-solution strengthening and increases high-temperature strength by being substituted at an Al site of the γ' phase. Thus, since a portion of Al is substituted with Ta and thus the effect can be obtained, Ta may be added if necessary. Excessive addition of Ta causes the γ' phase to become unstable at a high temperature. In addition, the harmful η phase or δ (delta) phase is formed and hot workability is impaired. Thus, an upper limit of Ta is set to 3%.

Nb: 0% to 3%

Similar to Ti or Ta, Nb is an element that causes the γ' phase to be subjected to solid-solution strengthening and increases high-temperature strength by being substituted at an Al site of the γ' phase. Thus, since a portion of Al is substituted with Nb and thus the effect can be obtained, Nb may be added if necessary. Excessive addition of Nb causes the γ' phase to become unstable at a high temperature. In addition, the harmful η phase or δ (delta) phase is formed and hot workability is impaired. Thus, an upper limit of Nb is set to 3%.

Each process in the present invention and a reason of limiting a condition thereof will be described below.

<Hot Working Material Heating Process>

Firstly, a hot working material of a Ni-based superalloy which has the above components is prepared. The hot working material which has a composition defined in the present invention is preferably produced by vacuum melting, similar to other Ni-based superalloys. Thus, it is possible to suppress oxidation of an active element such as Al and Ti and to reduce an inclusion. In order to obtain a higher graded ingot, secondary or tertiary melting such as electroslag remelting and vacuum arc remelting may be performed.

Although the above-described ingot can be used as the hot working material, an intermediate material obtained by performing plastic working such as hammer forging, press forging, rolling, and extrusion, after the melting can be also used as the hot working material in the present invention.

Then, in the present invention, hot working is performed on the hot working material by holding the hot working material at a high temperature. The hot working material is held at a high temperature, and thus an effect of causing a precipitate such as the γ' phase to be subjected to solid solution and softening the hot working material is obtained. In a case where the hot working material is an intermediate material, working distortion occurring by pre-working is removed, and thus an effect of causing subsequent working to be easily performed is also obtained.

The effects are significantly exhibited at a temperature of 950° C. or higher at which hot deformation resistance of the hot working material is reduced. If a heating temperature is too high, a probability of an occurrence of incipient melting at a grain boundary is increased and a crack may be caused in the subsequent hot working. Thus, an upper limit is set to1150° C. A lower limit of the temperature of the heating process is preferably 1000° C. and further preferably 1050° C. The upper limit of the temperature of the heating process is preferably 1140° C. and further preferably 1135° C.

A heating period required for obtaining the effect requires 1 hour in minimum. Preferably, the heating period is equal to or longer than 2 hours. Although an upper limit of the heating period is not particularly defined, 20 hours may be set to be the upper limit because the effect is saturated and characteristics may be hindered, for example, crystal grains may be coarsened, if the heating period exceeds 20 hours.

<Hot Working Process>

In the present invention, the temperature of a die provided for hot working is also important. It is necessary that the die of a hot working device has a temperature which is set to be near the hot working material, in order to suppress heat of the hot working material from being dissipated to the die during the hot working process. The effect is significantly exhibited by setting the die temperature to be equal to or higher than 800° C. However, in order to maintain the die at a high temperature, a large-size heating mechanism or a large-size temperature holding mechanism, and large power consumption are needed. Thus, an upper limit temperature is set to 1150° C. The temperature of the die is a surface temperature of a work surface of the die for working the hot working material. A suitable heating temperature of the die is within ±300° C. of a surface temperature of the hot working material heated in the hot working material heating process.

In the present invention, hot working is performed by using the heated material to be subjected to hot forging and the die. As the hot working performed here, for example, hot forging (including hot pressing), hot extrusion, and the like are provided as long as a material obtained by hot working is used for aircraft engine or a gas turbine for power generation. Among the methods, hot die forging or isothremal forging by using a heated die is particularly suitable for applying the present invention. In this case, in the hot forging, application to hot pressing is suitable.

In the present invention, it is important that local working heat generation does not occur in hot working such as hot die forging or isothremal forging. Thus, it is preferable that an upper limit of a strain rate is set to be 0.1/second and an occurrence of working heat generation is suppressed. If the local working heat generation occurs, the grain size is partially changed. In order to more reliably suppress the occurrence of the local working heat generation, an upper limit of a strain rate is preferably set to be 0.05/second. It is preferable that a lower limit of the strain rate is set to be 0.001/second and is more preferably set to be 0.003/second. Similar to a case of natural cooling, a gradual decrease of the temperature occurs in a material worked in hot forging. However, since the lower limit of the preferable strain rate is satisfied, it is possible to prevent the decrease of the temperature of the material worked in hot forging by the working heat generation occurring in the hot forging.

Further, in the present invention, a temperature after hot working is also important. Specifically, as a difference between a temperature of the hot working material at a time of initial heating (temperature at a time of heating in the hot working material heating process) and the temperature of the hot working material when hot working is ended becomes smaller, plastic deformation stably occurs in the material and the entirety of the material after working is deformed to be homogeneous. In addition, it is possible to obtain a homogeneous microstructure without a risk of an occurrence of a surface crack by the decrease of the temperature of the material. Thus, it is preferable that the difference between the heating temperature and the temperature when hot working is ended becomes small. In addition, it is preferable that the temperature between the heating temperature of the hot working material and a working end temperature thereof is in a range of 0° C. (the heating temperature of the hot working material is equal to the working end temperature thereof) to −200° C. More preferably, the temperature difference is in a range of 0° C. to 100° C. The temperature of the hot working material when hot working is ended is the surface temperature.

An appropriate alloy is used as the material of the die, and thus it is possible to perform hot die forging or isothremal forging in the air. As described above, the heating temperature of the die used in hot working such as hot die forging or isothremal forging is 800° C. to 1150° C., that is, a high temperature. As the die using this, a die which includes an alloy having excellent high-temperature strength on a work surface of at least the die for working the hot working material is preferable. Regarding this, for example, a hot die steel which is generally used has a temperature range which exceeds a tempering temperature. Thus, the die in hot forging is softened. In addition, even in a case of a Ni-based superalloy of a precipitation strengthened type, strength may be decreased. Thus, a Ni-based superalloy of a solid-solution strengthened type is preferably used. For example, although a Ni-based superalloy of a solid-solution strengthened type may be mounted on a work surface, the die itself including the work surface is preferably formed of a Ni-based superalloy of a solid-solution strengthened type.

Specifically, as the Ni-based superalloy of a solid-solution strengthened type, for example, an alloy defined in the above-described present invention, HASTELLOY alloy (trademark of Haynes International, Inc), and a Ni-based superalloy of a solid-solution strengthened type which has been suggested in JP-A-60-221542 or JP-A-62-50429 by the applicant are preferably used. Among the alloys, the Ni-based superalloy of a solid-solution strengthened type suggested by the applicant is particularly preferable because of being suitable for isothremal forging in the air.

EXAMPLES

Example 1

In order to confirm the effect of the present invention by using a hot working material for a large-size Ni-based superalloy, two hot working materials A and B were prepared. The hot working material A is a Ni-based superalloy corresponding to Udimet720Li. The hot working material B is a Ni-based superalloy corresponding to one disclosed in Patent Document 1. The hot working materials A and B are alloys having a chemical composition on which performing hot working is most difficult from a viewpoint of the amount of the γ' phase, among superalloys for hot forging. For each material, hot forging and mechanical working were performed on a columnar Ni-based superalloy ingot which had been produced by using a vacuum arc remelting method which is an industrial melting method. The hot working materials A and B are formed to have a shape of ϕ203.2 mm×400 mmL as dimensions. Chemical composition of the hot working materials A and B are shown in Table 1.

TABLE 1

| Material | C | Al | Ti | Nb | Ta | Cr | Co | Fe | Mo | W | Mg | B | Zr |
|---|---|---|---|---|---|---|---|---|---|---|---|---|---|
| | | | | | | | | | | | | (mass %) | |
| A | 0.015 | 2.6 | 4.9 | 0.04 | 0.01 | 15.9 | 14.6 | 0.15 | 3.0 | 1.1 | 0.0003 | 0.02 | 0.03 |
| B | 0.014 | 2.3 | 6.3 | <0.01 | <0.01 | 13.5 | 24.0 | 0.40 | 2.9 | 1.2 | 0.0002 | 0.02 | 0.04 |

* Remainder is Ni and inevitable impurities.

A high-speed tensile test obtained by simulating a practical hot working process for a large-size member was performed on the hot working materials A and B. That is, in a case where hot working is performed by using a die which has a temperature lower than the heating temperature of the hot working material, heat dissipation from a free surface coming in contact with an outside air of the hot working material and a contact surface with the die significantly occurs and the γ' phase which is a strengthening phase is rapidly precipitated in accordance with the decrease of the temperature. Thus, hot ductility is rapidly degraded. Regarding the hot working materials A and B, the relationship between the decreased temperature of the material and hot workability was examined in order to confirm a practical range of the decrease of the temperature, which allowed stable hot working. Table 2 and FIG. 1 show a test condition and an evaluation result of hot ductility.

Since the appropriate hot working temperature of the alloy in the present invention is in a range of about 1000° C. to 1130° C., a tensile test is performed in a state where a first heating temperature as the representative is set to 1100° C. and the heating temperature is maintained to be constant, and hot ductility is evaluated. These are Tests No. A1 and B1. Next, in Tests No. A2, A3, A4, B2, B3, and B4 in which the first heating temperature is set to 1100° C., the temperature is lowered up to 1000° C., 950° C., 900° C. at a cooling rate of 200° C./min in order to simulate heat dissipation occurring in hot working of the hot working material, then a waiting time of 5 seconds for stabilizing the test temperature is provided, and the tensile test is performed. As the strain rate of all of the high-speed tensile tests, 0.1/second which is the general strain rate of hot working is employed.

In order to perform stable hot working in which a working crack does not occur, generally, it is preferable that reduction in area in the high-speed tensile test is equal to or greater than 60%. In an alloy series having a large amount of the precipitated γ' phase as in the alloy in the present invention, the large amount of the γ' phase is precipitated in accordance with the decrease of the temperature. Thus, deformation resistance is increased and hot ductility is largely degraded. As shown in the results of Table 2 and FIG. 1, it is understood that hot ductility is degraded in accordance with the progress of the decrease of the temperature. In a case of the hot working material B, if the temperature is decreased to 200° C., good hot ductility can be secured. Thus, it is understood that the material temperature is preferably set to be within −200° C. with respect to the heating temperature in order to perform stable hot working. In a case of the hot working material A, if the temperature is within −100° C. with respect to the heating temperature, 60% or more of reduction in area in a wide composition range can be secured. Thus, more preferably, the material temperature is set to be within −100° C. with respect to the heating temperature.

Example 2

In order to confirm the effect of the present invention, a forming work in which a disk material which had dimensions equivalent to those of the practical product and has a pancake shape was produced was performed on the hot working materials A and B. The materials were heated to 1100° C. in an atmospheric furnace, and then pressure of 80% was applied under a condition of a strain rate of 0.01/second in a free forging press machine in which the temperature of a die was set to 900° C. Thereby, a pancake-like disk having an outer diameter of about 470 mm and a height of 80 mm was formed. The following Table 3 shows

TABLE 2

| Test No. | Hot working material | First heating process | Cooling condition (° c./min) | Second heating process | Temperature decrease (° c.) | Strain rate (/second) | Reduction in area (%) |
|---|---|---|---|---|---|---|---|
| A1 | A | 1100° C. × 10 minutes | None | None | 0 | 0.1 | 99 |
| A2 | A | 1100° C. × 10 minutes | 200 | 1000° C. × 5 seconds | 100 | 0.1 | 69 |
| A3 | A | 1100° C. × 10 minutes | 200 | 950° C. × 5 seconds | 150 | 0.1 | 27 |
| A4 | A | 1100° C. × 10 minutes | 200 | 900° C. × 5 seconds | 200 | 0.1 | 24 |
| B1 | B | 1100° C. × 10 minutes | None | None | 0 | 0.1 | 98 |
| B2 | B | 1100° C. × 10 minutes | 200 | 1000° C. × 5 seconds | 100 | 0.1 | 76 |
| B3 | B | 1100° C. × 10 minutes | 200 | 950° C. × 5 seconds | 150 | 0.1 | 70 |
| B4 | B | 1100° C. × 10 minutes | 200 | 900° C. × 5 seconds | 200 | 0.1 | 61 |

the heating temperature in a forging process and a disk surface temperature when forging is ended.

TABLE 3

| Material | Heating temperature (° C.) of hot working material | Material surface temperature (° C.) when forging is ended | Material dimensions (mm) | Dimensions (mm) after forging |
|---|---|---|---|---|
| A | 1100 | 1009 | ϕ203.2 × 400 | ϕ477 × 80.5 |
| B | 1100 | 1002 | ϕ203.2 × 400 | ϕ477 × 80.0 |

Figure 2:
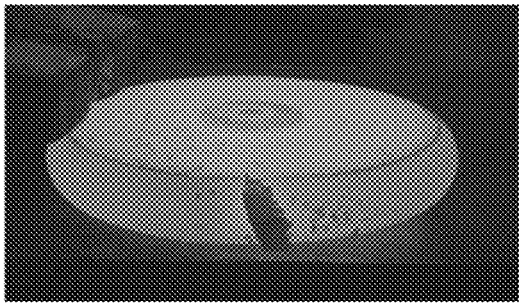
FIG. 2 is a figure of an appearance of a Ni-based superalloy after hot working, in an embodiment of the present invention.
Figure 2:
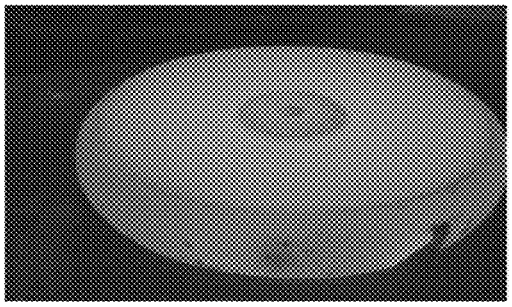
Figure 3:
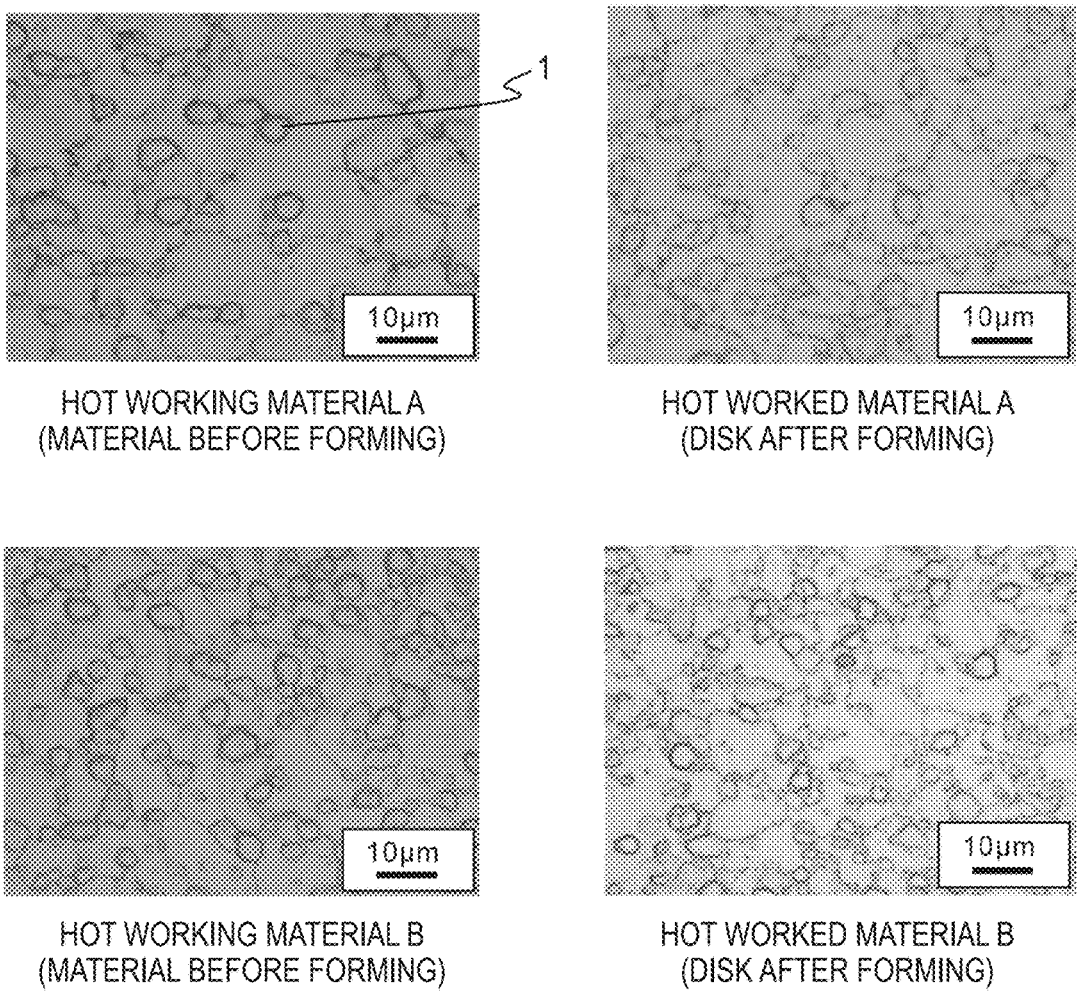
FIG. 3 is an optical microphotograph figure illustrating a microstructure of the Ni-based superalloy in the embodiment of the present invention.

According to Table 3, it is implied that a temperature difference between the heating temperature and the forging end temperature is about 100° C., that is, vary small, and thus heat generation by working heat generation and heat dissipation from the die are balanced. As a result, FIG. 2 illustrates a figure of the appearance of the hot working materials A and B. However, a pancake-like disk having no appearance scratch and practical size dimensions can be manufactured. FIG. 3 illustrates figures of microstructures of the hot working materials A and B before disk forming and after disk forming.

As illustrated in FIG. 3, it is understood that a very fine structure in which a fine structure of a material billet is maintained even after disk forming is obtained, and coarsening or incipient melting of crystal grains which causes degradation of yield strength or fatigue strength never occurs.

Then, in order to more clearly confirm the effect of the present invention, a forming work of producing a disk material having a pancake shape was performed on a hot working material C. The hot working material C is a material which passes through the hot forging process, but has a working rate much lower than that of the hot working materials A and B. The hot working material C is a material having a coarse microstructure itself as a result. Table 4 shows a composition of the hot working material C.

The hot working material C is a Ni-based superalloy corresponding to one disclosed in Patent Document 1. The hot working material C is an alloy having a chemical composition on which performing hot working is most difficult from a viewpoint of the amount of the γ' phase, among superalloys for hot forging. Hot forging and mechanical working were performed on a columnar Ni-based superalloy ingot which had been produced by using a vacuum arc remelting method which is an industrial melting method. Thereby, the hot working material C having a shape of ϕ203.2 mm×200 mmL as dimensions of the hot working material was obtained.

TABLE 4

| Material | C | Al | Ti | Nb | Ta | Cr | Co | Fe | Mo | W | Mg | B | Zr |
|---|---|---|---|---|---|---|---|---|---|---|---|---|---|
| | | | | | | | | | | | | | (mass %) |
| C | 0.014 | 2.1 | 6.1 | <0.01 | <0.01 | 13.4 | 24.9 | 0.11 | 2.8 | 1.1 | 0.0001 | 0.01 | 0.03 |

* Remainder is Ni and inevitable impurities.

Figure 4:
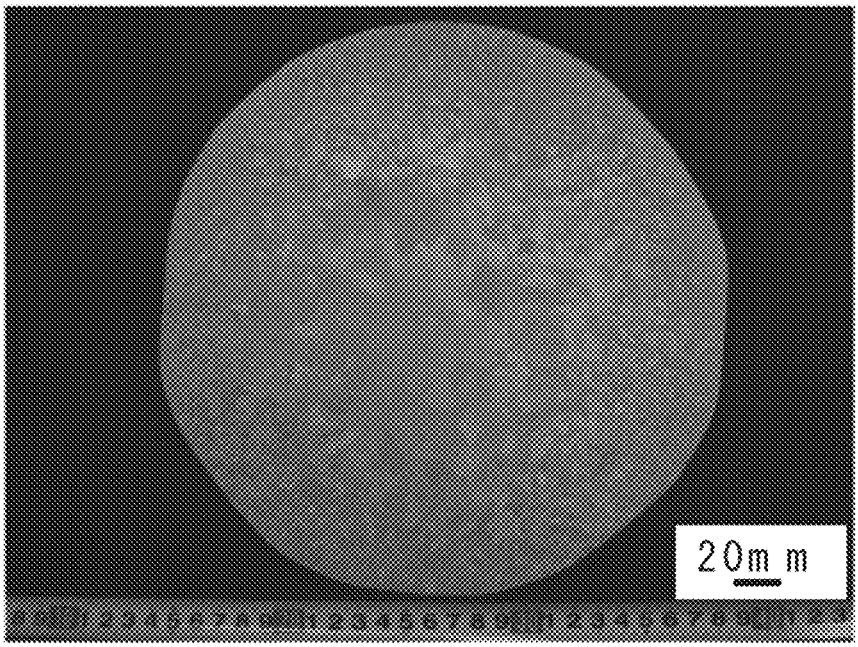
FIG. 4 is a figure of a macrostructure of a hot working material C in the embodiment of the present invention.

FIG. 4 illustrates a sectional macrostructure of the hot working material C. As illustrated in FIG. 4, it is understood that the hot working material C has a coarse structure. The hot working of the present invention is performed on the hot working material C, and thus it is confirmed that it is possible to perform hot working without an appearance crack or scratch even by using a hot working material in which the microstructure is not fine, in the present invention. The hot working material C was heated to 1100° C. in an atmospheric furnace, and then pressure of 60% was applied under a condition of a strain rate of 0.01/second in a free forging press machine in which the temperature of a die was set to 900° C. Thereby, a pancake-like disk having an outer diameter of about 321 mm and a height of 80 mm was formed. Table 5 shows an initial heating temperature in the forging process and a disk surface temperature when forging is ended.

TABLE 5

| Material | Heating temperature (° C.) of hot working material | Material surface temperature (° C.) when forging is ended | Material dimensions (mm) | Dimensions (mm) after forging |
|---|---|---|---|---|
| C | 1100 | 1011 | ϕ203.2 × 200 | ϕ321 × 80 |

Figure 5:
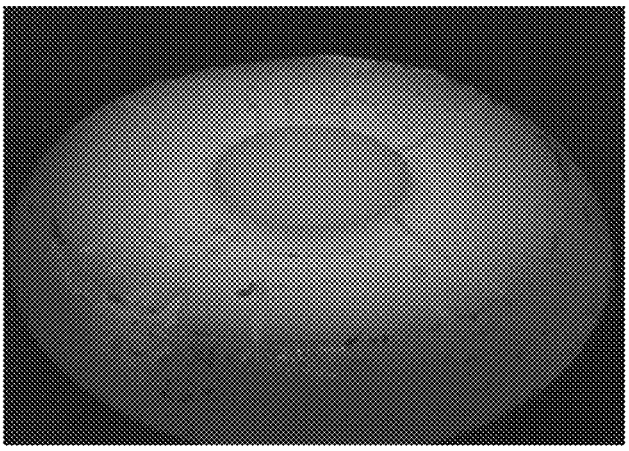
FIG. 5 is a figure of an appearance of the hot working material C in an embodiment of the present invention.

As shown in Table 5, similar to Table 3, it is implied that a temperature difference between the heating temperature and the forging end temperature is about 100° C., that is, vary small, and thus heat generation by working heat generation and heat dissipation from the die are balanced. FIG. 5 illustrates a figure of the appearance of the hot working material C after forging. Similar to FIG. 3, it is understood that a pancake-like disk having no appearance scratch and practical size dimensions can be manufactured. From this, it is implied that the present invention is a producing method in which sufficient hot working is possible even for a superalloy having a coarse microstructure.

Hitherto, the present invention is applied even to a Ni-based superalloy in which hot workability is significantly degraded in accordance with the decrease of the temperature. It is understood that the temperature of the hot working material is hardly changed, and thus hot working is very stably performed. Accordingly, it is shown that a product which is formed of a Ni-based superalloy of a γ' precipitation strengthened type and is used for an aircraft engine or a gas turbine for power generation can be stably supplied.

INDUSTRIAL APPLICABILITY

According to the method of producing a Ni-based superalloy in the present invention, it is possible to produce a Ni-based superalloy which can be applied to production of a high-strength alloy used in a forged component, particularly, a turbine disk of an aircraft engine and a gas turbine for power generation, and has high strength and excellent hot workability.

The invention claimed is:

1. A method of producing a Ni-based superalloy in which a hot working material of a Ni-based superalloy is subjected to hot working with a die heated to a temperature, the hot working material having a composition consisting of, in mass%, 0.001 to 0.050% of C, 1.0% to 4.0% of Al, 3.0% to 7.0% of Ti, 12% to 18% of Cr, 12% to 30% of Co, 1.5% to 5.5% of Mo, 0.5% to 2.5% of W, 0.001% to 0.050% of B, 0.001% to 0.100% of Zr, 0% to 0.01% of Mg, 0% to 5% of Fe, 0% to 3% of Ta, 0% to 3% of Nb, and the remainder of Ni and impurities, the method comprising:

a hot working material heating step of heating and holding the hot working material in a temperature range of 950° C. to 1150° C. for 1 hour or longer; and a hot working step of performing hot working on the hot working material at a strain rate of 0.005/second to 0.05/second with the die that is heated to the temperature in a range of 800° C. to 1150° C.

2. The method of producing a Ni-based superalloy according to claim 1, wherein, in the hot working step, an atmosphere is in an air and at least a work surface of the die is a Ni-based solid-solution strengthened superalloy.

3. The method of producing a Ni-based superalloy according to claim 1, wherein the hot working material is produced by a melting method.

4. The method of producing a Ni-based superalloy according to claim 1, wherein, in the hot working step, a surface temperature of the hot working material when hot working is ended is set to be in a range of 0° C. to −200° C. with respect to a heating temperature of the hot working material.

5. The method of producing a Ni-based superalloy according to claim 4, wherein, in the hot working step, an atmosphere is in an air and at least a work surface of the die is a Ni-based solid-solution strengthened superalloy.

6. The method of producing a Ni-based superalloy according to claim 4, wherein, in the hot working step, the surface temperature of the hot working material when hot working is ended is set to be in a range of 0° C. to −100° C. with respect to the heating temperature of the hot working material.

7. The method of producing a Ni-based superalloy according to claim 6, wherein, in the hot working step, an atmosphere is in an air and at least and at least a work surface of the die is a Ni-based solid-solution strengthened superalloy.

* * * * *